US009341038B2

(12) United States Patent
Le Briere et al.

(10) Patent No.: US 9,341,038 B2
(45) Date of Patent: May 17, 2016

(54) TOOL FOR EXTRACTING AN OBJECT ENGAGED IN A FLUID EXPLOITATION PIPE, EXTRACTION DEVICE AND RELATED METHOD

(75) Inventors: Bruno Le Briere, Paris (FR); Christophe Michaud, Soignolles en Brie (FR)

(73) Assignee: Geoservices Equipements, Paris Nord II (FR)

( * ) Notice: Subject to any disclaimer, the term of this patent is extended or adjusted under 35 U.S.C. 154(b) by 323 days.

(21) Appl. No.: 13/996,553

(22) PCT Filed: Dec. 21, 2011

(86) PCT No.: PCT/EP2011/006475

§ 371 (c)(1),
(2), (4) Date: Sep. 1, 2013

(87) PCT Pub. No.: WO2012/084227

PCT Pub. Date: Jun. 28, 2012

(65) Prior Publication Data

US 2013/0333895 A1 Dec. 19, 2013

(30) Foreign Application Priority Data

Dec. 21, 2010 (EP) ..... 10306468

(51) Int. Cl.
*E21B 23/04* (2006.01)
*E21B 23/00* (2006.01)
*E21B 31/20* (2006.01)

(52) U.S. Cl.
CPC ..... *E21B 23/04* (2013.01); *E21B 23/00* (2013.01); *E21B 31/20* (2013.01)

(58) Field of Classification Search
None
See application file for complete search history.

(56) References Cited

U.S. PATENT DOCUMENTS

| | | | | |
|---|---|---|---|---|
| 4,838,594 | A * | 6/1989 | Bullard | E21B 31/20 166/125 |
| 7,051,810 | B2 * | 5/2006 | Clemens et al. | 166/301 |
| 9,010,432 | B2 * | 4/2015 | Edwards | E21B 23/04 166/338 |
| 9,027,657 | B2 * | 5/2015 | Varkey | E21B 23/14 166/380 |
| 2005/0056427 | A1 | 3/2005 | Clemens et al. | |
| 2007/0289745 | A1 * | 12/2007 | Richards | E21B 23/06 166/339 |
| 2009/0272544 | A1 * | 11/2009 | Giroux | E21B 47/122 166/382 |

OTHER PUBLICATIONS

Dennis McDaniel, et al, "Case History: Extended Stroke Downhole Power Unit Successfully Pulls Subsea Wellhead Plugs," SPE 116221, pp. 1-8.

* cited by examiner

*Primary Examiner* — Matthew R Buck
*Assistant Examiner* — Douglas S Wood

(57) ABSTRACT

The tool includes a bearing member (70), a traction assembly (72) of the object (28), movably mounted in a first direction relative to the bearing member (70). It includes a plurality of hooking members (160), mounted radially mobile relative to the traction assembly (72) between a contracted configuration and a deployed configuration. The tool comprises means (164; 166) for keeping each hooking member (160) in its deployed configuration. It includes unlocking means (168; 170) that include an elastic stressing member (202; 222) applied on the holding means (164; 166). The elastic stressing member (202; 222) is capable of being compressed to cause the unlocking of the holding means (164; 166) and the passage of the hooking members (160) from their deployed configuration to their contracted configuration.

16 Claims, 8 Drawing Sheets

TOOL FOR EXTRACTING AN OBJECT ENGAGED IN A FLUID EXPLOITATION PIPE, EXTRACTION DEVICE AND RELATED METHOD

The present invention concerns a tool for extracting an object engaged in a fluid exploitation pipe, of the type comprising:

- a bearing member, intended to be axially immobilized against a bearing surface of the pipe;
- a traction assembly of the object, movably mounted in a first direction along an axis relative to the bearing member between a deployed placement position, a locked operating position in the object, and a traction position of the object;
- an actuator for moving the traction assembly relative to the bearing member;
- a plurality of hooking members, radially movably mounted relative to the traction assembly, between a radially contracted placement configuration and a radially deployed configuration for hooking the object;
- means for holding each hooking member in its deployed configuration; and
- means for unlocking the holding means.

The object is advantageously a plug arranged in a wellhead resting on the bottom of an expanse of water. Such a plug is generally called a "crown plug."

In a known manner, underwater wells formed in the bottom of an expanse of water are closed by a wellhead arranged on the bottom of the expanse of water. The wellhead defines an inner pipe for access to the well that is plugged, when the well is not in use, by a plug sealably mounted in the pipe.

When the well must be accessed, for example to perform an operation in the well, in particular to bring it back into production, a riser is installed on the wellhead.

Then, to remove the plug, a coiled hollow tubing is often used. The operations performed using these coiled tubings can be relatively costly and difficult to carry out. It is in fact necessary to implement a pulling force able to reach the vicinity of several tens of tons to extract the plug.

To offset this problem, an extraction tool of the aforementioned type is for example described in article SPE 116 221. This tool can be lowered using simple means such as a cable working line.

The bearing member of the extraction tool is applied against a surface of the pipe. A traction assembly provided with hooking clips is inserted, then locked in a cavity formed in the plug. The traction assembly is then moved relative to the bearing member by a jack present in the tool to free the plug and lift it out of the wellhead.

The plugs present in the well being at least partially in contact with the underwater environment, they can remain jammed. In that case, the force applied by the extraction tool may not be sufficient to remove the plug and the tool must be raised to the surface to use other more adapted tools.

If the locking members of the tool are jammed in the locked configuration, in the plug, it can be very difficult to extricate the extraction tool, which can lead to breaking the cable.

One aim of the invention is to have an extraction tool that enables very effective extraction of an object engaged in a well, while also being able to be disengaged from the object to be extracted very simply and reliably, in particular in case of emergency.

To that end, the invention relates to an extraction tool of the aforementioned type, characterized in that the unlocking means comprises at least one elastic stressing member applied on the holding means, the elastic stressing member being capable of being compressed to cause the unlocking of the holding means and the passage of the hooking members from their deployed hooking configuration towards their contracted configuration, in at least one first position of the traction assembly between the locked operating position and the traction position.

The extraction tool according to the invention can comprise one or several of the following features, considered alone or according to all technically possible combinations:

- the elastic stress member is axially compressible along the axis A-A' of movement of the traction assembly relative to the bearing member;
- the stressing member is capable of being compressed by applying hydraulic pressure exerted by a fluid present around the tool;
- the holding means comprise a first holding member that is axially mobile relative to the hooking members during the compression of the stressing member, between a first position in which the hooking members are kept in their deployed configuration and a second position in which the hooking members are free to go to their contracted configuration;
- the traction assembly includes a support, defining an orifice for receiving the stressing member and a guiding member for moving the holding means mounted movably in the cavity by compression of the stressing member, the guiding member being movable jointly with the first holding member;
- the elastic stressing member is capable of being compressed by relative movement of the traction assembly relative to the bearing member in a second direction opposite the first direction when the hooking members are kept in the deployed configuration by the holding means;
- the elastic stressing member is inserted between a first surface movable jointly with one of the bearing member and the traction assembly during the relative movement of the traction assembly relative to the bearing member in the second direction and a second surface integral with the holding means, the relative movement of the bearing member relative to the traction assembly in the second direction bringing the first surface closer to the second surface;
- when the stressing member is compressed, the bearing member and the traction assembly can be moved jointly to allow unlocking of the holding means by expansion of the elastic stressing member; and
- the movement actuator comprises a jack including a cylinder rod connected to the bearing member and a jacket for receiving the rod connected to the traction assembly.

The invention also relates to an extraction device for operating in a fluid exploitation pipe, of the type comprising:

- a tool as described above; and
- a wireline for deploying the tool towards the object, the wireline being connected to one of the bearing member and the traction assembly.

The extraction device can comprise one of the following features:

- the deployment wireline is a single-strand smooth cable;
- the device comprises a tube intended to be mounted between an upper assembly and a wellhead situated at the end of the pipe, the tube receiving a fluid, the extraction tool being movably mounted in the tube, the device comprising a means for pressurizing a fluid present in the tube to cause the compression of the stressing member.

The invention also relates to a method for extracting an object engaged in a fluid exploitation pipe, of the type comprising the following steps:

providing an extraction device as described above;

bringing the extraction tool near the object, using the deployment cable;

immobilizing the bearing member against a bearing surface of the pipe;

inserting hooking members in a reception cavity defined by the object;

deploying hooking members from their contracted configuration towards their deployed hooking configuration by moving the traction assembly relative to the bearing member in the first direction from its deployed position to its locked operating position; and pulling the object by moving the traction assembly from the locked operating position towards the traction position.

The method according to the invention can comprise one or several of the following features, considered alone or according to all technically possible combinations:

the method includes the following steps:

after deploying the hooking members in the object, compressing the elastic stressing member; then unlocking the holding means using the elastic stressing means;

passage of the hooking members from the deployed configuration towards the contracted configuration; it includes the following steps:

pressurizing a fluid situated around the tool to compress the elastic stressing means; and moving the holding means under the effect of the compression of the elastic stressing member to release the hooking members;

the compression step includes the relative movement of the traction assembly relative to the bearing member in a second direction opposite the first direction to cause the compression of the stressing member, the traction assembly advantageously remaining substantially immobile, the method then comprising the joint movement of the bearing member and the traction assembly to cause the extension of the elastic stressing member and the unlocking of the holding means.

The invention will be better understood upon reading the following description, given solely as an example, and done in reference to the appended drawings, in which.

Figure 1:
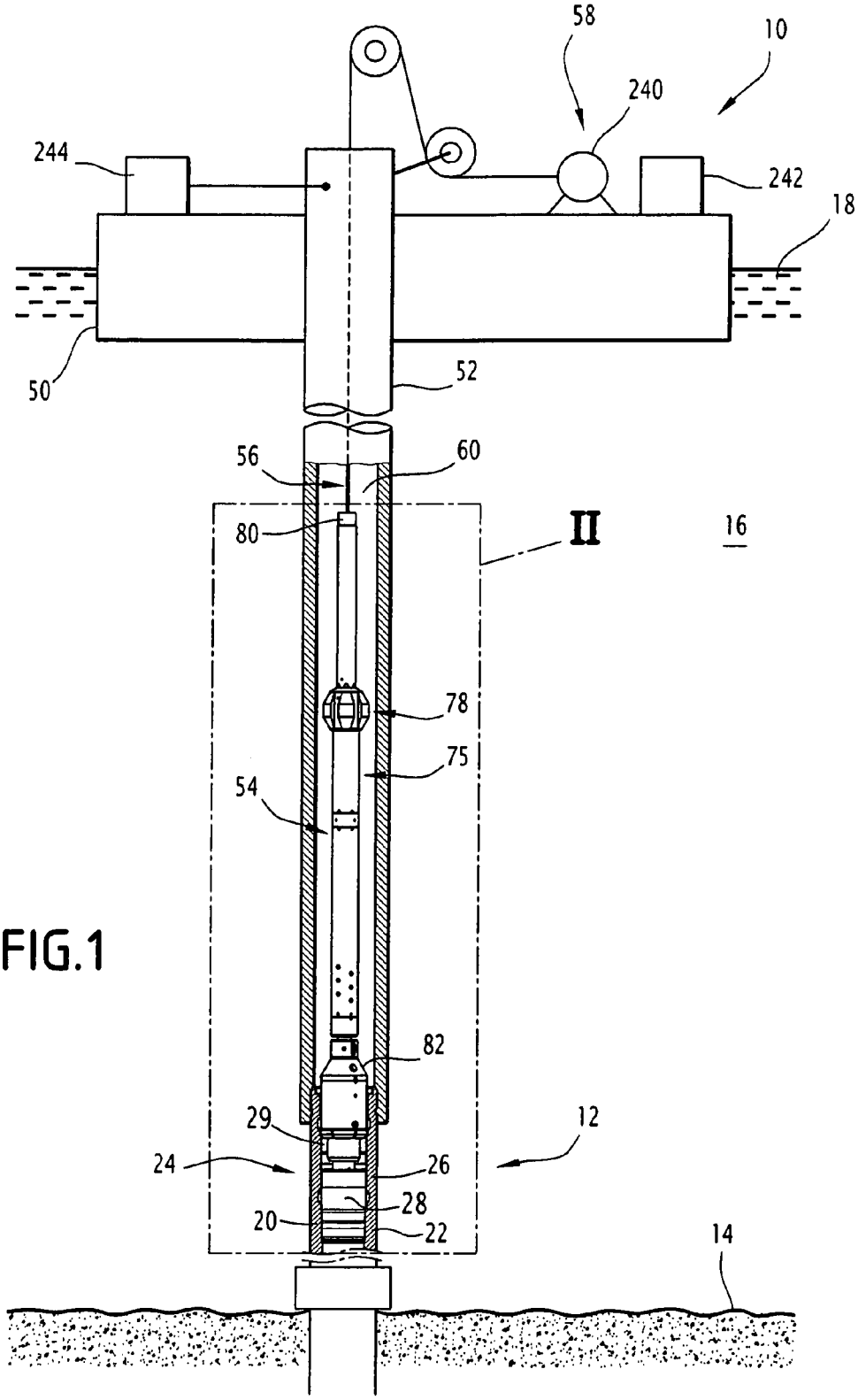
FIG. 1 is a diagrammatic and partial cross-sectional view of a first installation for operating in a well comprising an operating device according to the invention.

A first intervention device 10 according to the invention is shown in FIGS. 1 to 8. This device 10 is intended to operate in a well 12 that is advantageously located on the bottom 14 of an expanse of water 16. The expanse of water 16 is for example a sea, an ocean or a lake.

The depth of the expanse of water 16, between its surface 18 and the bottom 14, is greater than 100 m advantageously and is in particular between 100 m and 2000 m. although operations at depths higher than 2000 m could be envisaged.

The well 12 includes a pipe 20 arranged in a cavity 22 formed in the bottom 14 of the expanse of water 16. The cavity 22 connects a layer of fluid to be exploited to the bottom 14 of the expanse of water 16.

The fluid to be exploited is advantageously formed by hydrocarbons, such as oil or natural gas.

The well 12 is covered by a wellhead 24, shown diagrammatically in FIG. 1, which extends the pipe 20 upwards. The wellhead 24 includes an upper section 26 of the pipe 20, with axis A-A', vertical in FIG. 1, that protrudes above the bottom 14 of the expanse of water. The wellhead 24 includes at least one closing plug 28 designated by the term "crown plug, or "subsea wellhead" plug.

Figure 2:
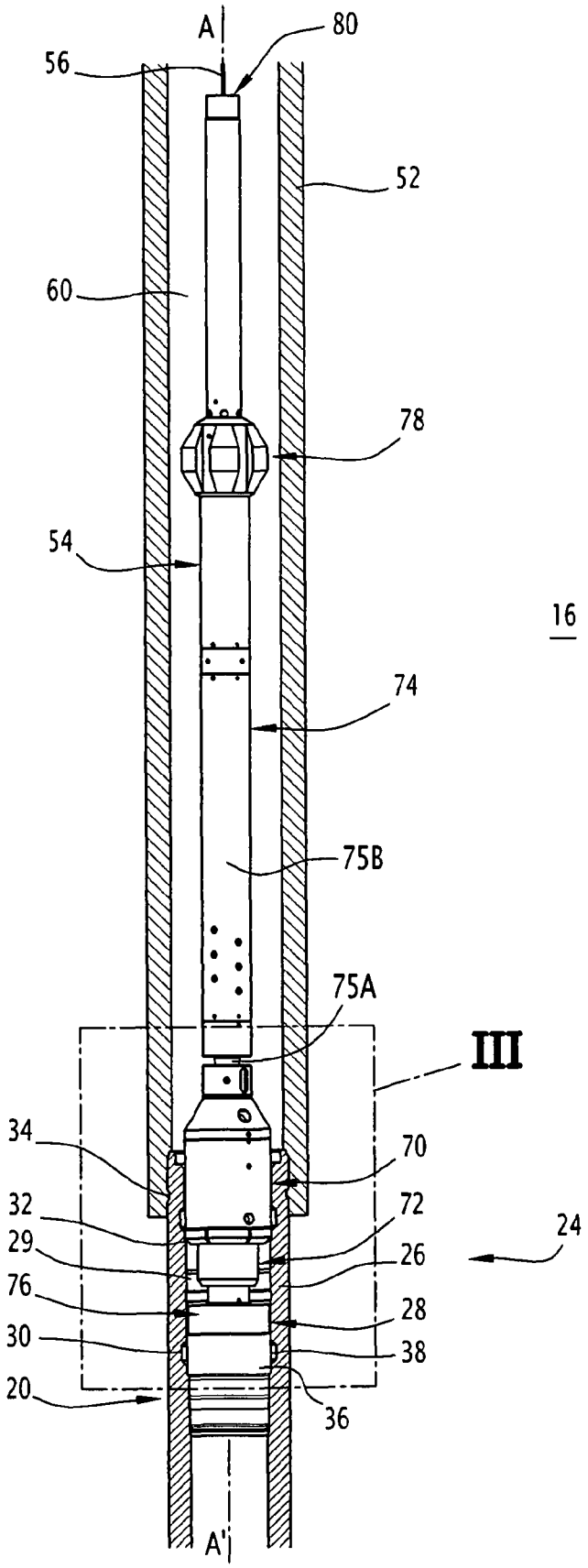
FIG. 2 is a view of a detail marked II in FIG. 1.

In reference to FIG. 2, the upper section 26 inwardly defines a central passage 29 with axis A-A', at least one lower groove 30 for hooking the plug 28, and at least one inner annular bearing shoulder 32 for an extraction tool of the plug 28, the shoulder 32 being situated above the groove 30.

The upper section 26 also outwardly defines an outer groove 34 for fastening a riser.

In reference to FIGS. 3 to 7, the plug 28 includes a cylindrical central body 36 with axis A-A', with a transverse section substantially complementary to the transverse section of the passage 29, anchoring clips 38 radially deployable in the inner groove 30, and a handling jacket 40 movable relative to the body 30 to allow the retraction of the clips 38 and the traction of the plug 28.

The handling jacket 40 includes a cavity 42 for receiving hooking members of the extraction tools. It defines a hooking rim 44 that protrudes radially towards the axis A-A' in the cavity 42. The hooking rim 44 defines an inner hooking shoulder 46 oriented downwards.

Figure 3:
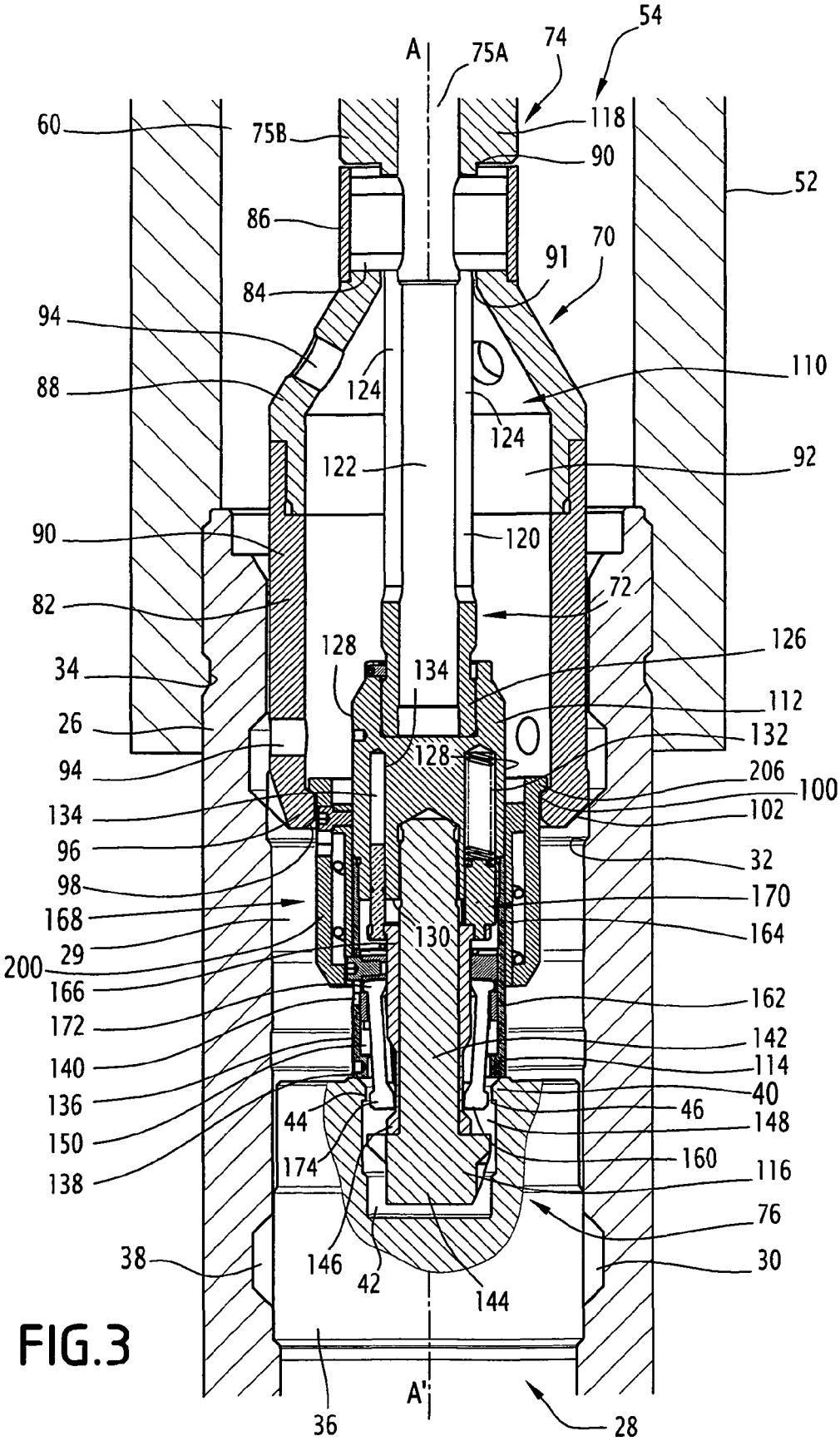
FIG. 3 is a view, in cross-section along a median axial plane, of a detail marked III in FIG. 2, during the insertion of an extraction tool according to the invention in a plug closing a wellhead.
Figure 5:
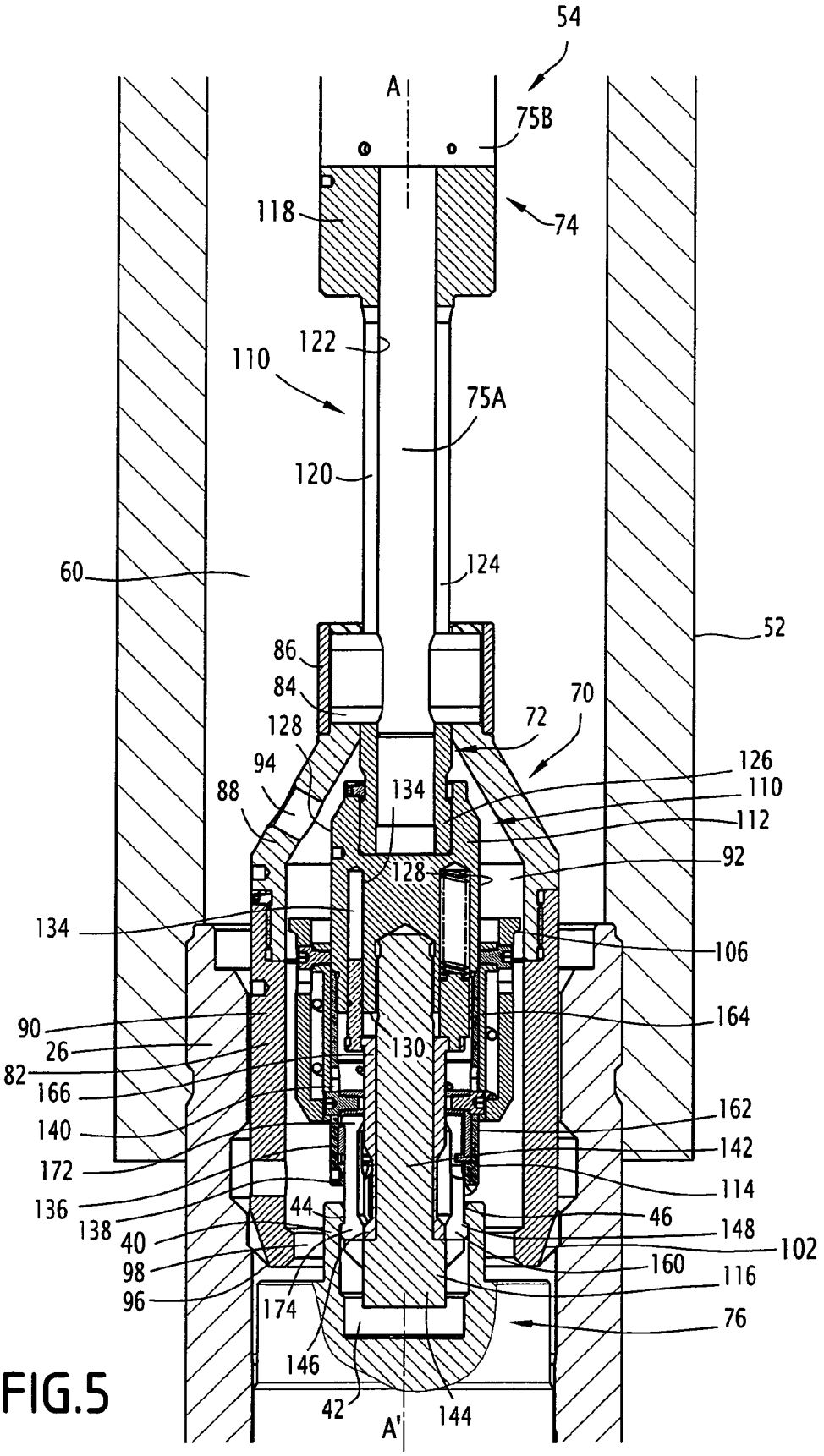
FIG. 5 is a view similar to FIG. 4, after traction of the plug.

The inner jacket 40 is axially movable along the axis A-A' of the plug 28, between a lower position retracted into the body 36, shown in FIG. 3, in which the clips 38 are radially deployed, and an upper released position of the clips 38, represented in FIG. 5, in which the jacket 40 is axially locked protruding beyond the body 36 and the clips 38 are radially retracted in the body 36.

In reference to FIG. 1, the operating device 10 includes a surface assembly 50, a riser 52 connecting the surface assembly 50 to the wellhead 24 through the expanse of water 16, an extraction tool 54 according to the invention, and a cable working line 56 to deploy the extraction tool 54 in the riser 52 up to the wellhead 24.

The device 10 also includes a means 58 for maneuvering the controlling and cable working line 56 and the extraction tool 54.

The surface assembly 50 is for example an assembly floating on the surface 18 of the expanse of water 16.

The riser 52 is for example formed by a hollow rigid pipe defining the inner lumen 60, of the riser type.

The inner lumen 60 receives a liquid capable of being pressurized.

In reference to FIG. 2, the extraction tool 54 generally extends along an axis A-A'. It includes a member 70 for bearing on the section 26, an assembly 72 for pulling on the plug 28, and a jack 74 for relative movement of the traction assembly 72 relative to the bearing member 74. The jack 74 includes a rod 75A and a jacket 75B receiving the rod 75A.

The extraction tool 54 also includes an assembly 76 for releasably locking the hooking assembly 72 in the plug 28, a center finder 78 and a connecting member 80 for connection to the cable working line 56.

As illustrated by FIG. 3, the bearing member 70 includes a bell 82 intended to be inserted in the central passage 29 of the upper section 26, a connecting member 84 for connecting to the rod 75A of the jack 74 and a retaining ring 86.

The bell 82 has an upper portion 88 converging upwards and a substantially cylindrical lower portion 90 intended to be inserted in the passage 29. It inwardly defines a cavity 92 for circulation of the traction assembly 72.

The upper portion 88 defines an upper opening 91 and a plurality of lateral fluid intake openings 94 allowing the fluid present in the riser 52 to circulate towards the cavity 92.

The lower portion 82 also defines fluid intake openings 94. It has a lower rim 96 that protrudes radially towards the axis A-A' in the cavity 92.

The lower rim 96 defines an opening 98 for passage of the traction assembly 72 emerging in the cavity 92. It defines an inner stop 100 for blocking the locking assembly 76 and an outer surface 102 for axial locking, intended to cooperate with the annular shoulder 32 defined by the upper section 26.

The connecting member 84 is mounted through the upper portion 88 and through the rod 75A of the jack 74. It fastens the rod 75A of the jack 74 on the bell 82. It also ensures rotational locking of the bell 82 around the axis A-A' relative to the rod of the jack 74.

The retaining ring 86 is fastened around the connecting member 84 to lock it in position.

The hooking assembly 72 includes, from top to bottom in FIG. 3, an intermediate upper member 110 at the jacket 75B of the jack 74, an intermediate support 112 and a lower guide sleeve 114 for guiding the locking member 76.

The hooking assembly 72 also includes a draw bar 116.

The connecting member 110 comprises an upper head 118 for connecting to the jacket 75B of the jack 74, which is extended downwards via a slotted tube 120 for guiding the rod 75A of the jack and connecting member 84.

The connecting head 118 is fastened on the jacket 75B of the jack 74.

It has an outer transverse section substantially equal to the outer transverse section of the retaining ring 86.

The slotted tube 120 protrudes through the upper opening 91 in the central cavity 92 along the axis A-A'. It includes an axial guide cavity 122, with a transverse section substantially complementary to the outer section of the rod 75A of the jack 74. The cavity 122 emerges transversely via two opposite lateral slots 124 for circulation of the connecting member 84. The slots 124 have a width substantially equal to the width of the connecting member 84.

The lower end 126 of the slotted tube 120 is fixedly mounted in an upper portion of the intermediate support 112.

Figure 8:
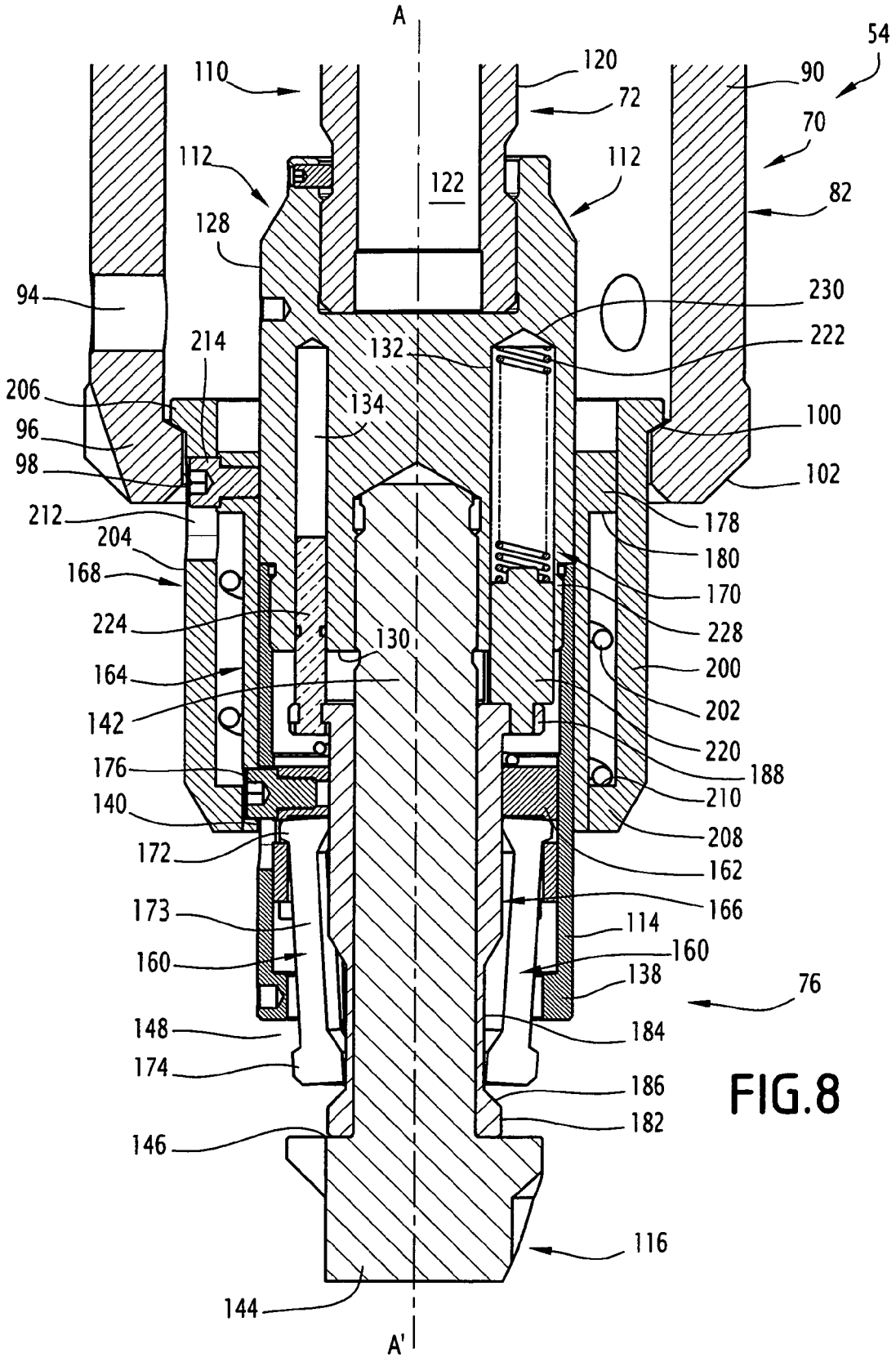
FIG. 8 is a detail view of FIG. 3.

In reference to FIG. 8, the support 112 has a minimum transverse section larger than the maximum transverse section of the slotted tube 120 and smaller than the minimum transverse section of the opening 98. It defines a cylindrical outer surface 128 with axis A-A' for sliding of the locking assembly 76.

The support 112 has a transverse lower surface 130 in which an axial orifice 132 and an auxiliary axial orifice 134 emerge.

The orifices 132 and 134 are blind.

As will be seen below, the orifices 132, 134 are intended to receive an unlocking means.

The sleeve 114 is fastened around the lower edge of the support 112. It has a peripheral outer surface 136 with axis A-A' that is outwardly flush with the outer sliding surface 128.

The sleeve 114 includes, along its lower edge, a traction rim 138 that protrudes towards the axis A-A'. The sleeve 114 also defines two axial notches 140 allowing axial travel between the hooking members of the locking assembly 76 and the traction assembly 72.

The draw bar 116 protrudes downwardly along the axis A-A' from the support 112. It has an upper region 142, fixedly mounted in the support 112 through the lower surface 130 opposite the sleeve 114, and a lower region 144 with a transverse expanse larger than the upper region 142, which protrudes downwards beyond the sleeve 114.

The lower region 144 defines, with the upper region 142, an annular lower shoulder 146 that extends transversely opposite the transverse surface 130.

The lower traction rim 138 is situated axially spaced away from the lower shoulder 146. The shoulder 146 and the rim 138 define a freed annular space between them for passage of the hooking members of the locking assembly 76.

Moreover, the upper region 142 of the bar 116 and the sleeve 114 define an annular housing 150 between them in which part of the locking assembly 76 is positioned.

As will be seen later, the traction assembly 72 can be moved in translation along the axis A-A' relative to the bearing member 70 in a first relative direction S1, between a deployed placement position, shown in FIG. 3, an intermediate position locked in the plug 28, shown in FIG. 4, and a traction position of the plug 28, shown in FIG. 5.

In reference to FIG. 8, the locking assembly 76 includes a plurality of hooking members 160 radially deployable between a contracted configuration for insertion in the plug 28 and a deployed configuration for locking the plug 28.

The locking assembly 76 also includes a retaining ring 162 of the hooking members 160, a member 164 for axial holding of the hooking members 160 and a member 166 for radial holding of the hooking members 160.

According to the invention and as will be described below, the locking member 76 comprises a means 168 for unlocking the axial holding member 164, which can be actuated by moving the traction assembly 72 relative to the bearing member 70, and means 170 for unlocking the radial holding member 166, which can be actuated by applying hydraulic pressure.

Each hooking member 160 includes a base 172 retained in the ring 162, a thinner intermediate portion 173 and a hooking head 174. Each member 160 thus has a vertical section substantially in the shape of a capital I.

Each hooking member 160 is pivotably mounted around its base 172 between the contracted configuration towards the axis A-A', shown in FIG. 3, and a radially deployed configuration, shown in FIG. 5.

In the contracted configuration, each member 160 is inclined towards the axis A-A', with its head 174 closer to the axis A-A' than its base 172.

In the deployed configuration, each member 160 extends substantially parallel to the axis A-A'.

The ring 162 axially retains the base 172 of each hooking member 160. It is mounted axially mobile along the axis A-A', sliding along the radial holding member 166, between an upper position and a lower position, over an axial travel equal to that of the axial notch 140.

The axial holding member 164 is slidingly mounted along the axis A-A' on the outer surfaces 128, 136. It is axially fastened on the support ring 162 via a screw 176 inserted in the axial notch 140. The screw 176 limits the axial travel of the axial holding member 164 and the ring 162.

The axial holding member 164 includes, near its upper edge, a radial skirt 178 that protrudes radially spaced away from the axis A-A'. The skirt 178' defines an annular lower transverse surface 180, capable of cooperating with the axial unlocking means 164, as will be seen later.

The radial holding member 166 is formed by a jacket slidingly mounted along the axis A-A', arranged bearing between the traction rod 116 and the support ring 162.

The holding member 166 includes a lower region 182 for deployment of the members 160 and a hollow intermediate region 184 defining an annular groove. The intermediate region 184 is connected to the lower region 182 by an inclined region 186.

The radial holding member 166 also includes an upper flange 188 fastened on the unlocking means 170.

As will be seen later, in a normal state, the unlocking means 170 is inactive and axially holds the holding member 166 in a deployed lower axial position in which the lower region 182 is arranged bearing against the lower shoulder 146.

Under the effect of hydraulic pressure applied in the riser 52, the radial holding member 166 can be moved along the axis A-A' towards the transverse surface 130 to an upper position releasing the hooking members 160.

The unlocking means 168 of the axial holding member 164 includes an inner bell 200 and a first elastic stress member 202 inserted between the inner bell 200 and the axial holding member 164.

The inner bell 200 has a central portion 204 with an outer transverse section substantially complementary to that of the opening 98, an upper rim 206 and a lower rim 208.

The upper rim 206 protrudes radially spaced away from the axis A-A' from the central portion 204. It has a transverse section larger than that of the opening 98. As will be seen later, the rim 206 can cooperate with the lower rim 96 of the bell 82 to prevent the relative movement of the inner bell 200 downwards in relation to the bearing member 72.

The lower rim 208 protrudes radially towards the axis A-A' from the central portion 204. It bears outwardly on the axial holding member 164. It defines a transverse surface 210 for retaining the stressing member 202 extending opposite the transverse surface 180.

The central portion 204 defines an upper axial notch 212 limiting the travel of the axial holding member 164 relative to the inner bell 200. An indexing stop 214, fastened in the skirt 178 of the member 164, protrudes radially through the notch 212.

The elastic stressing member 202 is arranged between the upper surface 180 and the lower surface 210, in the intermediate space defined between the inner bell 200 and the axial holding member 164. It is formed by a helical spring.

According to the invention and as will be seen later, the first stressing member 202 can be axially compressed during a relative movement of the hooking assembly 72 relative to the bearing member 70 to cause, after joint movement of the bearing member 70 and the hooking assembly 72, the release of the hooking members 160.

The means 170 for unlocking the radial holding member 166 includes a guide rod 220 and a second elastic stressing member 222 mounted in the receiving orifice 132. They also include a piston 224 slidingly mounted in the guide orifice 134.

The guide rod 220 is fastened by its lower end on the radial holding member 166. It has an upper bearing surface 228 for a second elastic stressing member 222.

The second stressing member 222 is formed by a weighted helical spring. It is positioned bearing between the bottom 230 of the orifice 134 and the bearing surface 228.

As seen above, under the effect of hydraulic pressure applied on the fluid present in the riser 52, the piston 220 is capable of sliding upwards in the orifice 134 and compressing the stressing member 222. This drives the radial holding member 166 in translation along the axis A-A' from its lower position towards its upper position.

The rod 224 is slidingly mounted in the cavity 134. Its lower end is fastened on the skirt 188.

In reference to FIG. 2, the jack 74 comprises, aside from the rod 75A, and the jacket 75B, a hydraulic generator (not shown) able to deploy the rod 75A downwards relative to the jacket 75B.

In this example, the rod 75A is fixed with the connecting member 80 at the cable working line 56. The jacket 75B is fixed with the bearing member 70.

In reference to FIG. 1, the cable working line 56 is advantageously formed by a solid single-strand smooth cable of the "piano wire" or "slickline" type. This cable has a tensile strength greater than 300 daN and between 300 daN and 1500 daN and a resistance greater than 30 mΩ/m and in particular between 30 mΩ/m and 500 mΩ/m.

In one alternative, an electrically insulating exterior coating is applied on the outer surface of the cable 56 to allow the transmission of data from the surface towards the extraction tool 54 as described in French patent application FR 2 848 363 by the Applicant, for example.

Alternatively, any conveyance wireline suitable for intervention in the well may be used in place of the smooth cable 56, such as an electric wire line or a coiled tubing.

The handling and control means 48 comprises a winch 240 and a control unit 242 to handle the cable working line 56 and allow the lowering and raising of the tool 54, as well as the control for activating the jack 74.

The handling and control means 48 also comprises a pressurization unit 244 for pressurizing the liquid present in the riser 52 to increase the pressure of that liquid and activate the emergency unlocking of the hooking members 160 when necessary.

The operation of the operating device 10 comprising an extraction tool 54 according to the invention will now be described.

Initially, the wellhead 24 is closed by a plug 28. To that end, the clips 38 of the plug 28 are received in the inner groove 30 and lock the plug 28 in position in the upper section 26.

To remove the plug 30, a riser 52 is first placed through the expanse of water 16 between the surface assembly 50 and the wellhead 24.

The lower end of the riser 52 is sealably fastened around the upper section 26. Then, the lower end of the cable working line 56 is connected on the connection head 80, at the upper end of the extraction tool 54. As specified above, the head 80 is thus axially secured to the rod 75A of the jack 74 to move jointly with said rod 75A relative to the chamber 75B.

In reference to FIG. 1, the extraction tool 54 is then lowered through the riser 52 up to the wellhead 24.

The lower end of the traction assembly 72 and of the bearing member 70 then penetrate the central passage 29 of the upper section 26.

The hooking assembly 72 occupies its deployed placement position, illustrated by FIGS. 3 and 8. In this position, it protrudes downwards outside the bearing member 70. The bell 82 is placed substantially in contact with the connection head 118 of the connecting member 110.

In this position, the distance that separates the lower end of the traction assembly 72 from the lower edge 96 of the bearing member 70 is maximal.

The downward movement of the tool 54 continues until the traction assembly 72 abuts against the plug 28. The traction rim 138 of the sleeve 114 is then arranged bearing on an upper surface of the plug 38 situated around the central cavity 42.

The operator then detects a voltage drop on the cable working line 56. As illustrated by FIG. 3, the lower region 144 of the draw bar 116, the deployment region 182 of the radial holding member 166 and the hooking heads 74 have entered the central cavity 42.

The support ring 162 occupies its upper position in the notches 140. Thus, the distance that axially separates the transverse surface 130 from the hooking members 160 is maximal. Moreover, the hooking members 160 occupy their retracted configuration and are received in the hollow intermediate region 184.

The lower portion 82 of the bell 90 is arranged in the upper section 26. The lower stop surface 102 is situated above and axially spaced away from the bearing shoulder 32.

The hydraulic pressure of the liquid present in the riser 52 and treating the tool 54 is less than the force necessary for the compression of the second stressing member 222. Thus, the radial holding member 166 occupies its lower position abutting against the shoulder 146 defined by the lower region 144 of the draw bar 116.

The surface operator then controls the jack 74 to cause the partial deployment of the cylinder rod 75A downwards towards the chamber 75B, and the passage of the traction element 72 from the placement position, towards a locked operating position.

The cable working line 54 being relaxed, the relative deployment of the rod 75A relative to the jacket 75B downwards along the axis A-A' causes the bell 82 to be lowered towards the bearing shoulder 32 via the connecting member 84.

The traction assembly 72 then rises in the cavity 92.

Figure 4:
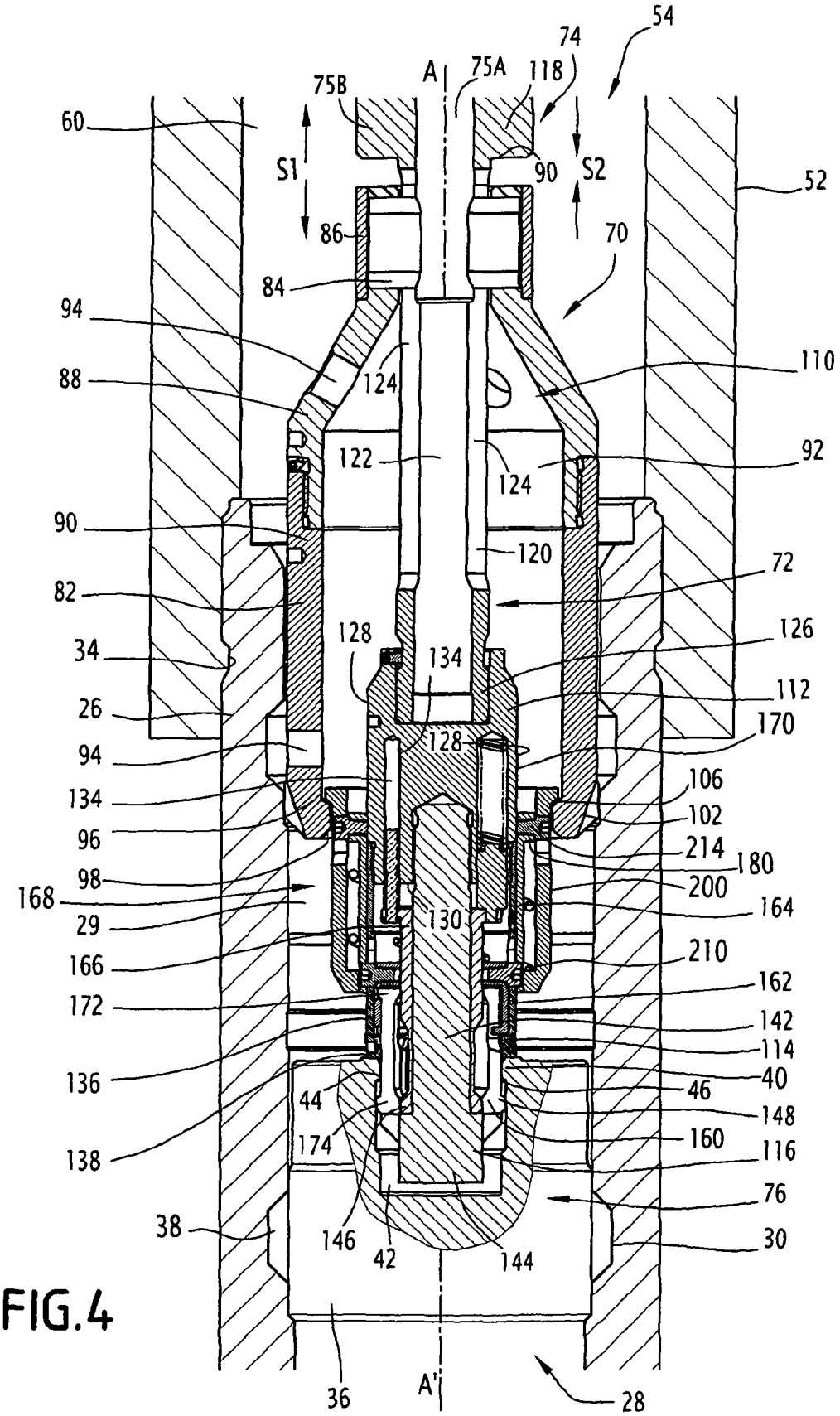
FIG. 4 is a view similar to FIG. 3, after locking hooking members of the extraction tool in the plug.

During this movement, and as illustrated by FIG. 4, the inner bell 200 and the axial holding member 164 move jointly with the bell 82 under the effect of the axial expansion force exerted by the first stressing member 202 between the surfaces 180 and 210. During this movement, the stop 214 remains bearing against the upper end of the upper notch 212.

The screw 176 then descends in the lower notch 140. Thus, the axial holding member 164 moves downwards towards the traction assembly 72' by sliding on the outer surfaces 128 and 136.

The axial movement of the axial holding member 164 pushes the support ring 162 and the hooking members 160 downwards. The hooking heads 174 then come into contact with the inclined region 186 situated on the radial holding member 166, which causes the radial deployment of the heads 174. At the end of travel, the heads 174 bear transversely against the deployment regions 182 and abut axially against the lower region 144 of the draw bar 116.

In this locked operating position, and as illustrated by FIG. 4, the hooking members 160 occupy their deployed configuration and are locked in the central cavity 42 of the inner jacket 40 of the plug 28.

The maximum transverse expanse of the hooking members 160 is then greater than the minimal transverse expanse of the cavity 42, taken at the rim 44.

To extract the plug 28, the jack 74 is activated again. The deployment of the rod 75A away from the jacket 75B continues. This deployment causes the relative movement of the traction assembly 72 towards the bearing member 70 from the locked position towards a traction position.

However, the lower surface 102 of the bell 80 being arranged bearing against the annular shoulder 32 of the upper section 26, the bearing member 70 remains axially immobile relative to the upper section 26.

The deployment of the rod 75A then causes the upward movement of the chamber 75B, and by sliding of the connecting member 86 in the slots 124, the insertion of the rod 75A in the cavity 122.

As illustrated by FIG. 5, the connecting member 110 then moves upwards, which drives the support 112, the sleeve 114 and the draw bar 116 in the cavity 92 defined by the bell 82. During that movement, the hooking members 160, in their deployed configuration, move jointly with the traction assembly 72. The inner sleeve 40 of the plug 28 is pulled upwards relative to the central body 36 of the plug 28. The clips 38 retract and the plug 28 is released outside the section 26.

The extraction tool 54 on which the plug 28 is hooked can then be raised up to the surface assembly 50 by simple raising of the cable working line 56.

It is therefore particularly simple to carry out the extraction of the plug 28, since the force necessary for the extraction is supplied by the jack 74. The tool 54 can therefore be lowered using a cable working line 56, which substantially reduces the cost of the operation.

According to the invention, and in case of emergency, the hooking members 160 in their deployed configuration can be disengaged from the plug 28, even when the traction assembly 72 and the bearing member 70 occupy a locked position as shown in FIG. 4.

In a first embodiment, this unlocking is obtained by compression of the first stressing member 202.

To that end, by starting from the position shown in FIG. 4, the surface operator actuates the cable working line 56 to pull the cylinder rod 75A towards the chamber 75B upwards along the axis A-A'.

Figure 6:
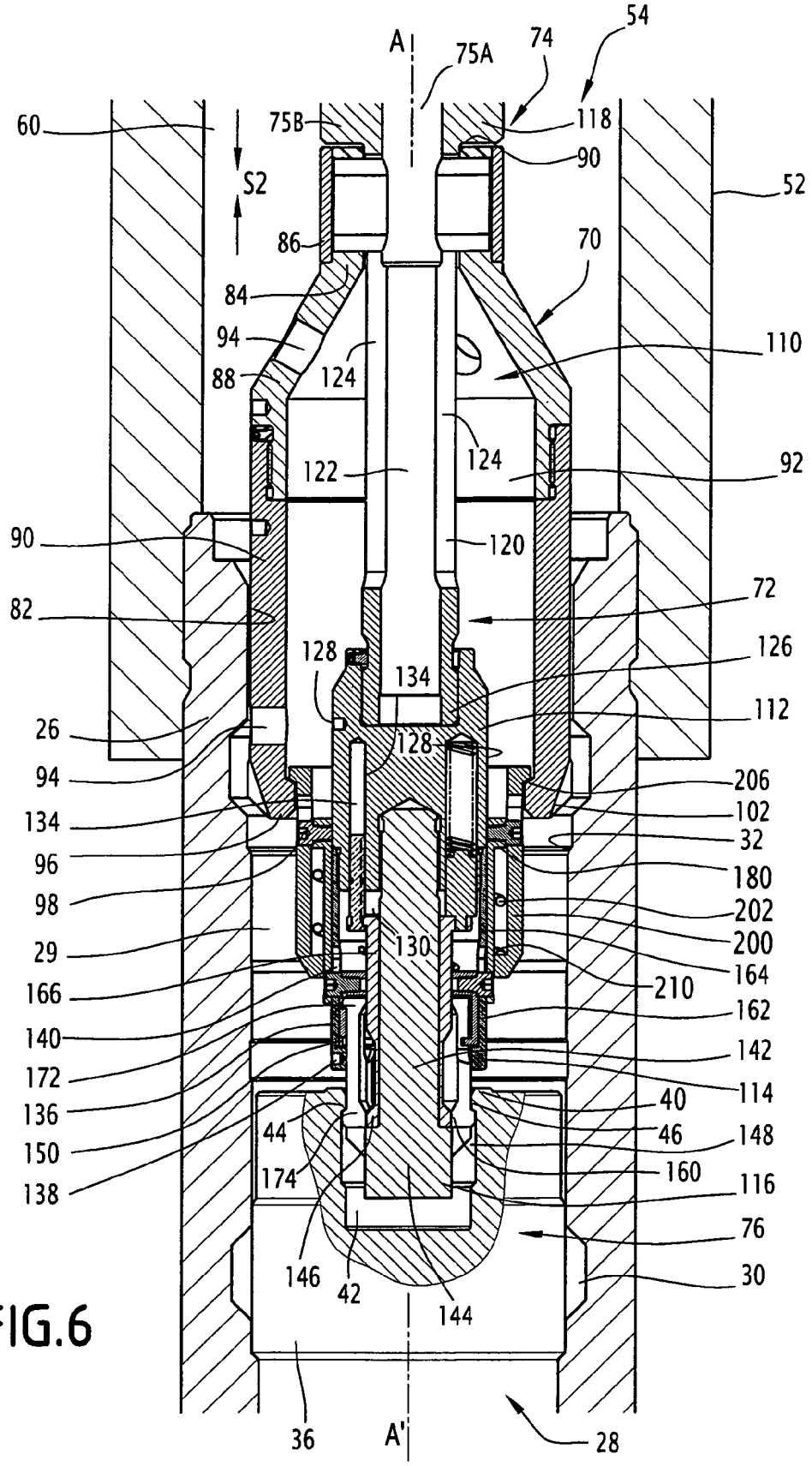
FIG. 6 is a view similar to FIG. 4, during emergency unlocking of the extraction tool shown in FIG. 5, done using the cable working line.

As illustrated by FIG. 6, this causes, via the connecting member 84, the upward movement of the bell 82. The hooking assembly 72 remains axially locked by cooperation between the hooking members 160 and the upper rim 44 of the plug 28 and is therefore progressively deployed outside the bell 82.

The bearing member 70 therefore moves in the second direction S2 relative to the hooking assembly 72.

The upward movement of the bell 82 drives that of the inner bell 200 by cooperation between the lower rim 96 and the upper rim 206. The stop 214 then slides in the upper notch 212, which brings the lower surface 180 situated on the axial holding member 164 of the upper surface 210 situated on the lower rim 208 closer to the inner bell 200. The elastic stressing member 202 compresses.

During this movement, the axial holding member 164 remains substantially immobile relative to the traction assembly 72.

When the pressure in the chambers of the jack 74 is equalized, the cable working line 54 is relaxed to allow the joint movement of the traction, assembly 72 and the bearing member 70 downwards.

During this downward movement, the first compressed stressing member 202 deploys axially. This causes the sliding of the axial holding member 164 upwards on the upper surfaces 128, 136.

This sliding drives the support ring 162 and then, the hooking means 160 upwards relative to the traction assembly 72 and relative to the radial holding member 166. The hooking heads 174 then pass over the inclined region 186, then in the hollow region 184, which causes the passage of the hooking members 160 in their contracted configuration.

Figure 7:
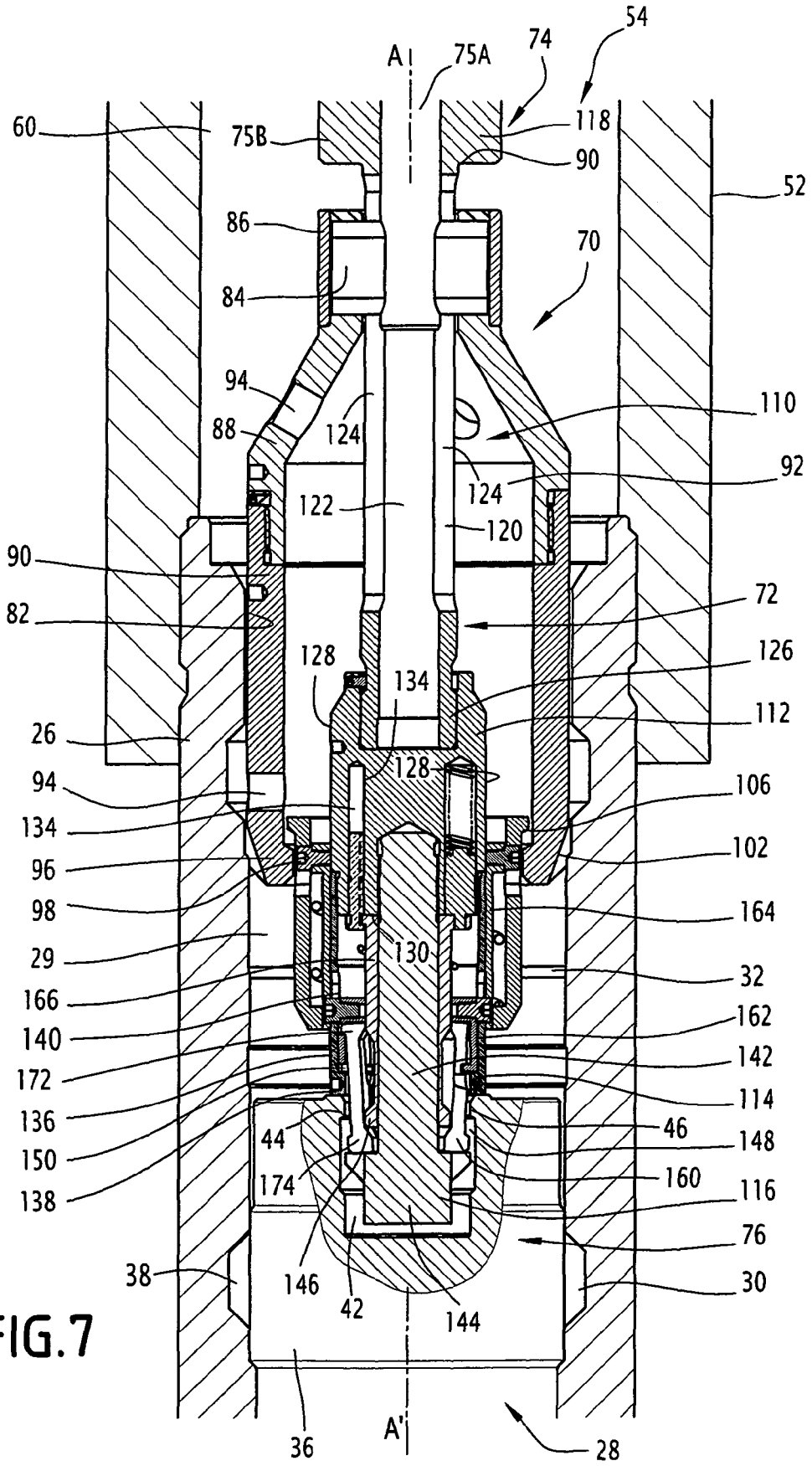
FIG. 7 is a view similar to FIG. 4, during emergency unlocking of the extraction tool shown in FIG. 5 implemented by applying hydraulic pressure.

In a second embodiment shown in FIG. 7, the release of the hooking members 160 is done, by compression of the second elastic stressing member 222, using the fluid present in the riser 52.

To that end, starting from the locked position in FIG. 4, the pressurizing unit 244 for pressurizing the fluid present in the riser 52 is activated on the surface by the operator.

The pressure of the fluid present in the column 52 is transmitted to the fluid situated inside the cavity 92 of the bell 82 through the openings 92, 94 and is also transmitted to the fluid present under the hooking assembly 72, between the hooking assembly 72 and the plug 28, in particular via the upper notch 212 and the lower notch 140.

Under the effect of this hydraulic pressure, the radial holding member 166 exerts a force on the elastic stressing member 222 present in the reception passage 132 via the guide rod 220.

When the hydraulic pressure increases enough, the stressing member 222 contracts axially parallel to the axis A-A' in the orifice 132 and the radial holding member 166 moves axially upwards relative to the traction assembly 72 towards the lower surface 130.

As illustrated by FIG. 7, the hooking members 160 remain axially in position.

The movement of the radial holding member 166 therefore causes the passage of the upper region 184 above the hooking heads 174, which frees an intermediate space between the heads 174 and the draw bar 116.

The hooking members 160 therefore pass freely from their deployed configuration to their contracted configuration, which makes it possible to extract them from the central cavity 42.

The unlocking means 168, 170 therefore simply and reliably ensures the emergency disconnection of the extraction tool 54 when it must be raised to the surface, even if the hooking members 160 are locked in position in the plug 28.

In particular, it is not necessary to detonate an explosive load, or to impact the tool 54 using a jar to release the hooking members 160 and release the extraction tool 54. This ensures a reliable use of the tool 54, even when a cable working line 56 formed for example by a smooth cable of the "slickline" type is used.

The unlocking can be done regardless of the relative position of the traction assembly 72 relative to the bearing member 70 between the locked operating position shown in FIG. 4 and the traction position shown in FIG. 5.

Alternatively, the tool 54 includes a memory programmed to control the actuation of the jack 74 without communication between the bottom and the surface.

In another alternative, the jack 74 is an electromechanical jack or a hydrostatic jack, and not a hydraulic jack.

In still another alternative, a pyrotechnical actuator is used in place of the jack 74.

The invention claimed is:

1. An extraction tool (54) for extracting an object (28) engaged in a fluid exploitation pipe (20), of the type comprising:

a bearing member (70), intended to be axially immobilized against a bearing surface (32) of the pipe (20);

a traction assembly (72) of the object (28), movably mounted in a first direction along an axis (A-A') relative to the bearing member (70) between a deployed placement position, a locked operating position in the object (28), and a traction position of the object (28);

an actuator (74) for moving the traction assembly (72) relative to the bearing member (70);

a plurality of hooking members (160), radially movably mounted relative to the traction assembly (72), between a radially contracted placement configuration and a radially deployed configuration for hooking the object (28);

a holder (164; 166) for holding each hooking member (160) in its deployed configuration; and an unlocker (168; 170) for unlocking the holder (164; 166);

wherein the unlocker (168; 170) comprises at least one elastic stressing member (202; 222) applied on the holder (164; 166), the elastic stressing member (202; 222) being capable of being compressed to cause the unlocking of the holder (164; 166) and the passage of the hooking members (160) from their deployed hooking configuration towards their contracted configuration, in at least one first position of the traction assembly (72) between the locked operating position and the traction position.

2. The tool (54) according to claim 1, wherein the stressing member (222) is capable of being compressed by applying hydraulic pressure exerted by a fluid present around the tool.

3. The tool (54) according to claim 2, wherein the holder (164; 166) comprise a first holding member (166) that is axially mobile relative to the hooking members (160) during the compression of the stressing member (222), between a first position in which the hooking members (160) are kept in their deployed configuration and a second position in which the hooking members (160) are free to go to their contracted configuration.

4. The tool (54) according to claim 3, wherein the traction assembly (72) includes a support (112), defining an orifice (132) for receiving the stressing member (222) and a guiding member (220) for moving the holder mounted movably in a cavity by compression of the stressing member (222), the guiding member (220) being movable jointly with the first holding member (166).

5. The tool (54) according to claim 1, wherein the elastic stressing member (202) is capable of being compressed by relative movement of the traction assembly (72) relative to the bearing member (70) in a second direction opposite the first direction when the hooking members (160) are kept in the deployed configuration by the holder (164).

6. The tool (54) according to claim 5, wherein the elastic stressing member (202) is inserted between a first surface (210) movable jointly with one of the bearing member (70) and the traction assembly (72) during the relative movement of the traction assembly (72) relative to the bearing member (70) in the second direction and a second surface (180) integral with the holder (164), the relative movement of the bearing member relative to the traction assembly in the second direction bringing the first surface (210) closer to the second surface (180).

7. The tool (54) according to claim 5, wherein when the stressing member (202) is compressed, the bearing member (70) and the traction assembly (72) can be moved jointly to allow unlocking of the holder (164) by expansion of the elastic stressing member (202).

8. The tool (54) according to claim 1, wherein the movement actuator comprises a jack (74) including a cylinder rod (75A) connected to the bearing member (70) and a jacket (75B) for receiving the rod (75A) connected to the traction assembly (72).

9. A device (10) for operating in a fluid exploitation pipe (20), comprising:

a tool (54) according to claim 1;

a wireline (56) for deploying the tool (54) towards the object (28), the wireline (56) being connected to one of the bearing member (70) and the traction assembly (72).

10. The device (10) according to claim 9, wherein the deployment wireline (56) is a single-strand smooth cable.

11. The device (10) according to claim 9, wherein it comprises a tube (52) intended to be mounted between an upper assembly (50) and a wellhead (64) situated at the end of the pipe (20), the tube (52) receiving a fluid, the extraction tool (54) being movably mounted in the tube (52), the device comprising a pressurizer (244) for pressurizing a fluid present in the tube (52) to cause the compression of the stressing member (222).

12. A method for extracting an object (28) engaged in a fluid exploitation pipe (20), comprising:

providing an extraction device (10) according to claim 9;

bringing the extraction tool (54) near the object (28), using the deployment cable (56);

immobilizing the bearing member (70) against a bearing surface (32) of the pipe (20);

inserting hooking members (160) in a reception cavity (42) defined by the object (28);

deploying hooking members (160) from their contracted configuration (72) towards their deployed hooking configuration by moving the traction assembly (72) relative to the bearing member (70) in the first direction from its deployed position to its locked operating position;

pulling the object (28) by moving the traction assembly (72) from the locked operating position towards the traction position.

13. The method according to claim 12, comprising:

after deploying the hooking members (160) in the object (28), compressing the elastic stressing member (202; 222); then unlocking the holder (164, 166) using the elastic stressing means (202; 222);

passage of the hooking members (160) from the deployed configuration towards the contracted configuration.

14. The method according to claim 13, comprising:

pressurizing a fluid situated around the tool (54) to compress the elastic stressing means (222), moving the holder (166) under the effect of the compression of the elastic stressing member (222) to release the hooking members (160).

15. The method according to claim 13, wherein the compression includes the relative movement of the traction assembly (72) relative to the bearing member (70) in a second direction opposite the first direction to cause the compression of the stressing member (202), the method then comprising the joint movement of the bearing member (70) and the traction assembly (72) to cause the extension of the elastic stressing member (202) and the unlocking of the holder (164).

16. The method according to claim 15, wherein, during compression, the traction assembly remains substantially immobile.

* * * * *